US005934551A

United States Patent [19]

Kaufman

[11] Patent Number: 5,934,551

[45] Date of Patent: Aug. 10, 1999

[54] FOUR PACK DISPLAY CONTAINER

[76] Inventor: Shari Kaufman, 317 Greens Farms Rd., Westport, Conn. 06880

[21] Appl. No.: 09/003,008

[22] Filed: Jan. 5, 1998

[51] Int. Cl.[6] ..... B65D 25/54

[52] U.S. Cl. ..... 229/162; 229/120.32; 229/120.23; 229/162; 229/120.38; 229/120.25; 206/776; 206/782; 206/765; 206/232

[58] Field of Search ..... 229/120.32, 120.23, 229/162, 120.35, 120.38, 120.25; 206/775, 776, 777, 782, 765, 769, 457, 232

[56] References Cited

U.S. PATENT DOCUMENTS

| | | | |
|---|---|---|---|
| 1,668,755 | 5/1928 | Bergmann | 229/120.23 X |
| 1,890,988 | 12/1932 | Harden | 206/424 X |
| 1,924,823 | 8/1933 | Willi | 229/162 X |
| 2,291,265 | 7/1942 | Viglietta | 229/120.23 X |
| 2,453,920 | 11/1948 | Kysela | 206/776 X |
| 2,483,464 | 10/1949 | Johnson | 229/115 |
| 3,199,670 | 8/1965 | Palmer | 229/162 |
| 3,953,273 | 4/1976 | Faller | 156/224 |
| 4,047,358 | 9/1977 | Heffernan et al. | 53/30 R |
| 4,053,050 | 10/1977 | Forbes, Jr. et al. | 206/361 |
| 4,071,140 | 1/1978 | Rattner | 206/295 |
| 4,146,128 | 3/1979 | Hogg et al. | 206/45.19 |
| 4,361,226 | 11/1982 | Travis | 206/45.31 |
| 4,846,775 | 7/1989 | Herrin | 493/95 |
| 4,925,087 | 5/1990 | Ostrander | 229/120.03 |
| 5,067,609 | 11/1991 | Stout | 206/45.11 |
| 5,264,996 | 11/1993 | Bele, Jr. et al. | 229/162 X |
| 5,409,105 | 4/1995 | Appelbaum et al. | 206/6.1 |
| 5,427,232 | 6/1995 | Buch | 206/45.29 |
| 5,582,293 | 12/1996 | Kay | 206/775 X |
| 5,622,264 | 4/1997 | Wetterlund | 206/765 |
| 5,775,949 | 7/1998 | Taplin | 206/776 X |

*Primary Examiner*—Gary E. Elkins
*Assistant Examiner*—Tri M. Mai
*Attorney, Agent, or Firm*—Hedman, Gibson & Costigan, P.C.

[57] ABSTRACT

A novel packaging container and method of packaging, for attractively and simply storing and displaying four related sets of objects is disclosed.

7 Claims, 4 Drawing Sheets

FOUR PACK DISPLAY CONTAINER

The present invention relates to a construction for a packaging container. More particularly, the present invention relates to a construction for a packaging container which is suitable for displaying at least four articles, and which is relatively simple and inexpensive to manufacture and assemble.

BACKGROUND OF THE INVENTION

In the retail merchandising of products to customers it has long been found that the sales are generally enhanced if the particular product being offered for sale is attractively presented to the customer at the point of sale. Many packaging constructions are known for this purpose. In some of these constructions, the packaging container is provided with a single window or large opening so that the product can be viewed from the exterior. The attractiveness is further enhanced if the opening is covered with a sheet of transparent material to give the appearance of a glassplaned window. Exemplary of prior art containers of this type are disclosed in Ostrander, U.S. Pat. No. 4,925,087; Stout, U.S. Pat. No. 5,067,609; Herrin, U.S. Pat. No. 4,846,775; and Applebaum et al., U.S. Pat. No. 5,409,105.

It is also known in the retail industry that the packaging of more than one object together can at times greatly enhance the marketability of one,or more of the packaged objects. This is especially the case when the objects to be packaged together have a common or related theme.

However, there has been no prior art packaging which has adequately addressed the issue of displaying the more than one objects. The displaying of the objects becomes more crucial when there are numerous objects to be displayed which cannot be adequately presented in windows on a single side of a package. The need for such a package is especially noticeable in the field of packaging one or more children's books with related toys such as a stuffed animal of a character in the book.

Thus, there is a need in the art for an improved packaging device wherein more than one article, and preferably at least four sets of related articles, can be displayed.

SUMMARY OF THE INVENTION

To this end, the present invention provides a packaging container which serves as an attractive display package for enhancing the appearance of the articles contained therein so as to improve the sales of the contained articles.

It is another object of the present invention whereby four related articles or sets of articles can be attractively and fully displayed in the packaging container.

It is a further object of the present invention to provide a packaging container which can be easily and simply constructed from one or more blanks capable of being produced on conventional fiberboard box and container forming equipment.

Briefly, in its broader aspects, the present invention provides a packaging container containing a front wall, a back wall, two side walls, a top side and a bottom side, wherein the sides and walls are joined to each other so as to form an enclosure of a generally rectangular configuration, and wherein each of the front wall, back wall and side walls has at least one opening therein for display of at least four separate but related articles contained within the enclosure.

The present invention further provides a blank for a container comprising a piece of material foldable to form a carton comprising: (a) a first panel comprising a central portion, a left side edge, a top side edge, a bottom side edge and a right side edge, wherein the central portion of the first panel comprises at least one window, the left side edge of the first panel is hingeably connected to a sealing flap; the top side edge of the first panel is hingeably connected to a top flap; and the bottom side edge of the first panel is hingeably connected to a bottom flap; (b) a second panel comprising a central portion, a left side edge, a top side edge, a bottom side edge and a right side edge, wherein the central portion of the second panel comprises at least one window; the left side edge of the second panel is hingeably connected to the right side edge of the first panel; the top side edge of the second panel is hingeably connected to a top end closing panel; and the bottom side edge of the second panel is hingeably connected to a bottom end closing panel; (c) a third panel comprising a central portion, a left side edge, a top side edge, a bottom side edge and a right side edge, wherein the central portion of the third panel comprises at least one window, the left side edge of the third panel is hingeably connected to the right side edge of the second panel; the top side edge of the third panel is hingeably connected to a top flap; and the bottom side edge of the third panel is hingeably connected to a bottom flap; and (d) a fourth panel comprising a central portion, a left side edge, a right side edge and a bottom side edge wherein the central portion of the fourth panel comprises at least one window; the left side edge of the fourth panel is hingeably connected to the right side edge of the third panel and the right side edge of the fourth panel is suitable for attachment to the sealing flap of the first panel.

The present invention still further provides a method for storing and/or displaying four related books and object sets comprising providing a generally rectangular container having four sides and two ends defining an interior compartment space; wherein each of the four sides comprises a window for displaying a book and object set therein; further providing the container with a means for partitioning the container into four quadrants, each quadrant facing one of the windows and each quadrant comprising a shelf means suitable for supporting an object on the top of the shelf and having an overhang suitable for providing a storage space for a book, in a manner such that both the object and the book are visible through its respective window.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS OF THE PRESENT INVENTION

The following description of the preferred embodiments of the present invention is for illustrative purposes only and should not be construed to limit the scope of the claims in any manner whatsoever.

Figure 1:
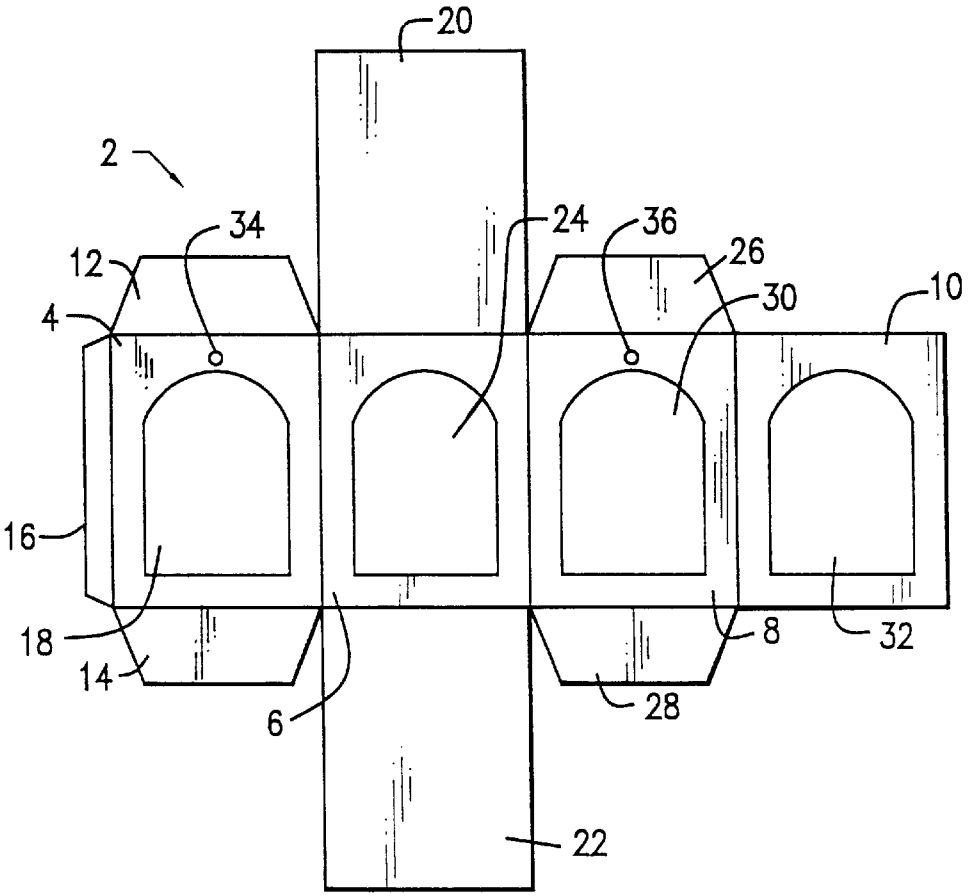
FIG. 1 shows a blank for the container of the present invention.

Referring to FIG. 1 there is shown a blank 2 of a container of the present invention. The blank is comprised of four generally rectangular panels 4, 6, 8 and 10, respectively. The left side edge of the first panel 4 is hingeably connected to a sealing flap 16; the top side edge of the first panel 4 is hingeably connected to a top flap 12; and the bottom side edge of the first panel 4 is hingeably connected to a bottom flap 14. These flaps may have any suitable shape as long as they are adequate for performing their respective functions, as will be discussed hereinbelow. In FIG. 1 each of the flaps hingeably connected to the first panel 4 have a trapezoidal shape.

The right side edge of the first panel 4 is hingeably attached to the left side edge of the second panel 6. The top side edge of the second panel is hingeably connected to a top end closing panel 20; and the bottom side edge of the second panel is hingeably connected to a bottom end closing panel 22. The top end closing panel 20 and the bottom end closing panel 22 are sized so that upon construction of the container from the blank 2, the panels 20 and 22 form the top and bottom of the container, respectively.

The right side edge of the second panel 6 is hingeably attached to the left side edge of the third panel 8. The top side edge of the third panel 8 is hingeably connected to a top flap 26; and the bottom side edge of the third panel 8 is hingeably connected to a bottom flap 28. These flaps may have any suitable shape as long as they are adequate for performing their respective functions, as will be discussed hereinbelow. In FIG. 1 each of the flaps hingeably connected to the third panel 8 have a trapezoidal shape.

The right side edge of the third panel 8 is hingeably attached to the left side edge of the fourth panel 10.

Critical to the present invention, each of the panels 4, 6, 8 and 10 have a central portion which contains at least one window 18, 24, 30 and 32, respectively. The panels may be provided with more than one window where the use of the container requires more windows. Additionally, it is contemplated that the top end 20 and the bottom end 22 may also be equipped with a window, if desired. The windows may take on any desired shape, size and configuration to attractively display the article or set of articles facing the window from inside the container.

The blank 2 is constructed of any suitable material for packaging of the items which the container is intended to hold. An important feature of the invention is that the blank 2 can be formed from a one-piece blank sheet of material thereby saving manufacturing and assembly costs. An embodiment of such a blank for forming a container is cut or die punched from a sheet or web of suitable material such as fiberboard, pasteboard or cardboard or the like. Fold lines may be provided between the panels and flaps by scoring or bending and the like as is known in the art.

The windows in the panels may also be cut or die punched at the time of forming the overall shape of the blank. The windows may be open, or alternatively, can be covered with a suitable sheet of transparent material to further enhance the appearance of the finished container and to protect the contents of the container from dirt, dust and the like as well as from abusive handling by customers. The transparent material, such as a clear or tinted acetate, can be secured to the edges of the window opening by any suitable adhesive or the like.

The container can then be readily assembled from the blank 2 by merely folding along the hingeable attachments or fold or score lines. Flaps 12 and 26 are folded inwardly to provide support for top closure flap 20, as is known in the art. Likewise, flaps 14 and 28 are folded inwardly to provide support for bottom closure flap 22.

Sealing flap 16 of the first panel 4 may be provided with an adhesive or other attachment means, and is adhered or otherwise attached to the right side of the fourth panel 10.

Top end panel 20 and the bottom end panel 22 cooperate with the top and bottom side, respectively of fourth panel 10, to provide a closed container. Top end panel 20 and bottom end panel 22 may be provided with flaps or other means for facilitating closure with the fourth panel.

It is further contemplated by the present invention that either of the opposing pairs of side panels, i.e. first panel 4 and third panel 8, or second panel 6 and fourth panel 10, may be provided with centrally located holes in the upper portion thereof. See reference characters 34 and 36 in FIG. 1. These holes may be threaded with a rope or yarn or other like material in order to facilitate carrying and displaying of the package. Other suitable alternative carrying means and displaying means are also contemplated for use in conjunction with the present invention, such as handles or hooks and the like which may be attached directly to the top closing panel 20.

From the foregoing, it is readily apparent that a packaging container formed from blank 2 provides an attractive display container for various types of articles and items, particularly those sold in four piece sets, such as four sets of related books with toys. While the containers of the present invention are particularly suitable as containers for book and toy sets, their use is not thereby so limited.

In this regard, it is contemplated that the containers of the present invention are further provided with inserts which are suitable as partitions, shelves and/or backgrounds. Although, the following description describes a particularly preferred arrangement for a four book/four toy set, other types of inserts and insert arrangements may be employed depending on the products to be sold in the packaging containers.

Figure 2B:
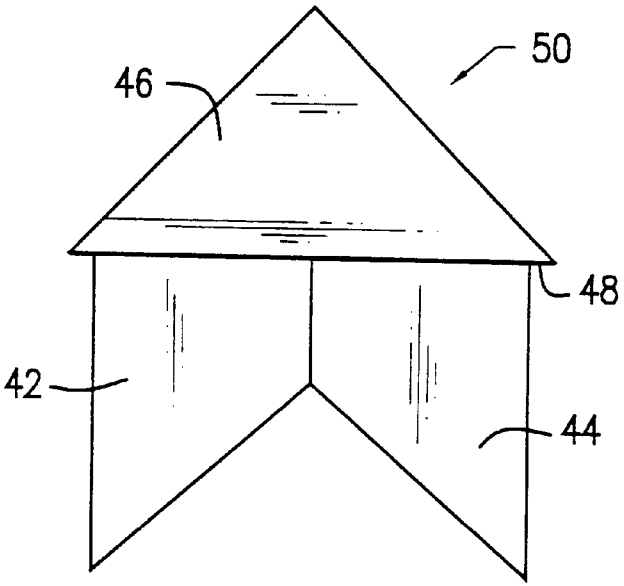
FIGS. 2A and 2B show a first insert useful in the containers of the present invention.
Figure 2A:
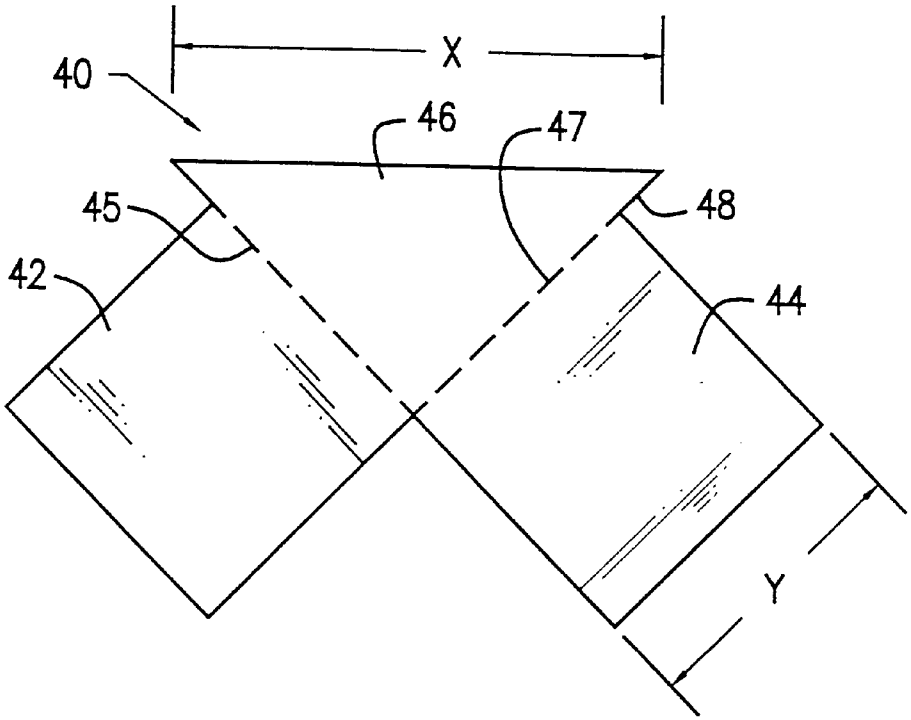

Referring to FIG. 2A there is shown a blank 40 for a stand suitable for use as a shelving insert in the containers of the present invention. Blank 40 is comprised of three panels 42, 44 and 46. Panel 46 is essentially an equilateral triangular panel wherein each side has a length x. Hingeably attached to a first side of triangular panel 46 is a first essentially square shaped panel wherein each side has a length y. Hingeably attached to a second side of the triangular panel 46 is a second essentially square shaped panel wherein each side also has a length y. Length x is greater than length y by an amount shown by overhang 48.

To form a stand from blank 40, the first panel 42 is folded downwardly along fold line 45 and the second panel 44 is folded downwardly along fold line 47 to form a stand 50 as shown in FIG. 2B. In a preferred embodiment the container of the present invention is provided with at least four such stands, each arranged in the container such that the edge along the overhang portion 48 of panel 46 is adjacent to a window of each side of the container.

Thus, it is preferred that length x is substantially the same as the width of the panels 4, 6, 8 and 10. The amount of overhang 48 is provided to be suitable for accommodating the thickness of the books to be sold in the packaging container of the present invention. The length y is sufficient to accommodate either the width or the height of the books to be sold in the packaging container of the present invention. Triangular panel 46 thereby forms a shelf for supporting a toy or other object which relates to the theme of or a character in the book which sits below the shelf under overhang 48.

Figure 3A:
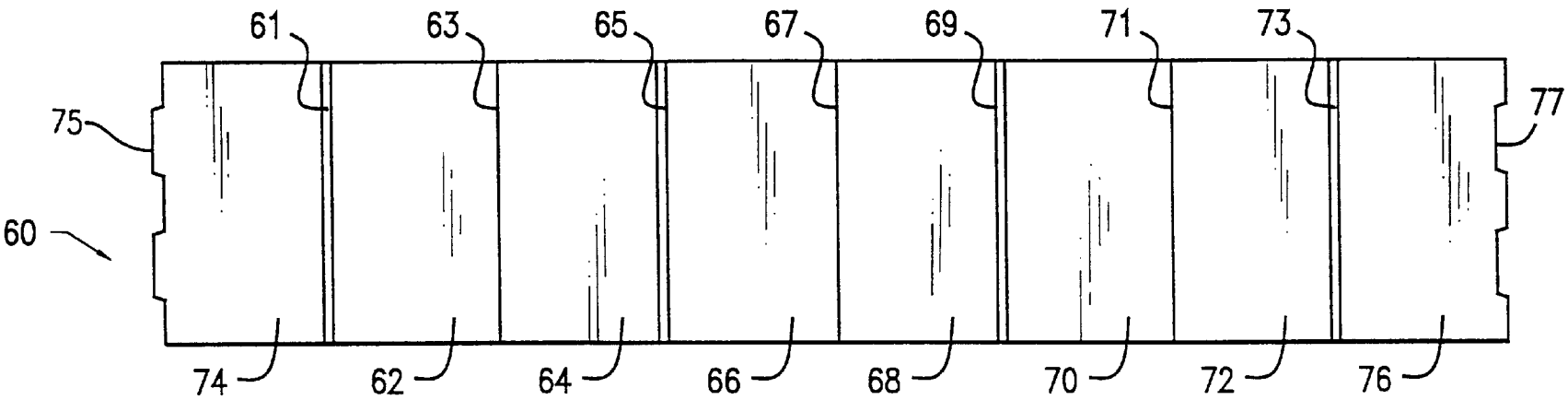
FIGS. 3A and 3B show a second insert useful in the containers of present invention.

It is also preferred to provide the packaging container of the present invention with a partitioning background insert. Referring to FIG. 3A there is shown a blank 60 for an x-shaped insert. Of course any other means for forming an x-shaped insert may be employed with the present invention such as two cardboard pieces which fit together via centrally located locking slots.

Blank 60 is comprised of four sets of panel pairs, 62 and 64, 66 and 68, 70 and 72, and 74 and 76. Each of the sets is divided by an end fold, 61 (set pairs 74, 76 and 62, 64), 65 (set paris 62, 64 and 66, 68), 69 (set pairs 66, 68 and 70, 72) and 73 (set pairs 70, 72 and 76, 74). Also, the three interior panel pairs (62, 64; and 66, 68; and 70, 72) are divided by interior fold lines 63, 67 and 71, respectively. The left hand edge of panel 74 is provided with attachment means 75 which cooperates with the attachment means 77 on the right hand side of panel 76.

Figure 3B:
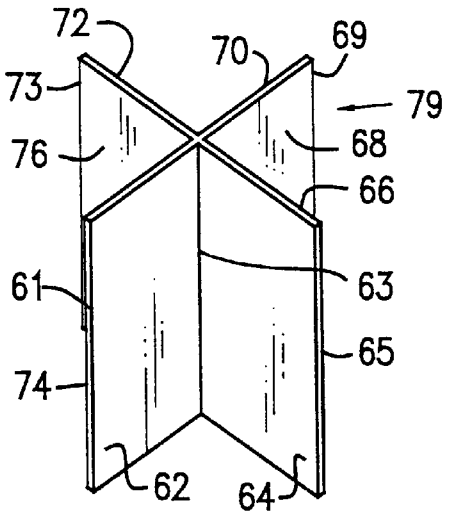

In this manner, one skilled in the art can discern that blank 60 may be folded in an accordion style along the fold lines, and by attaching attachment means 75 and 77, to form the x-shaped insert 79 as shown in FIG. 3B.

The triangular openings of the x-shaped insert 79 of FIG. 3B are sized in order to accommodate the triangular stands 50 as shown in FIG. 2B. In a further preferred embodiment, the triangular opening is decorated to coordinate with the book/toy combination or other object sets which are to be displayed in front of the triangular opening. Alternatively, the x-shaped insert may be decorated so that when removed from the box and opened it provides a play background for use with playing with the book/toy combinations.

Both of the inserts 50 and 79 may be constructed of any suitable lightweight material. For example the blanks for the inserts may be cut or die punched from a sheet or web of suitable material such as fiberboard, pasteboard or cardboard or the like. Fold lines may be provided between the panels and flaps by scoring or bending and the like as is known in the art.

Figure 4:
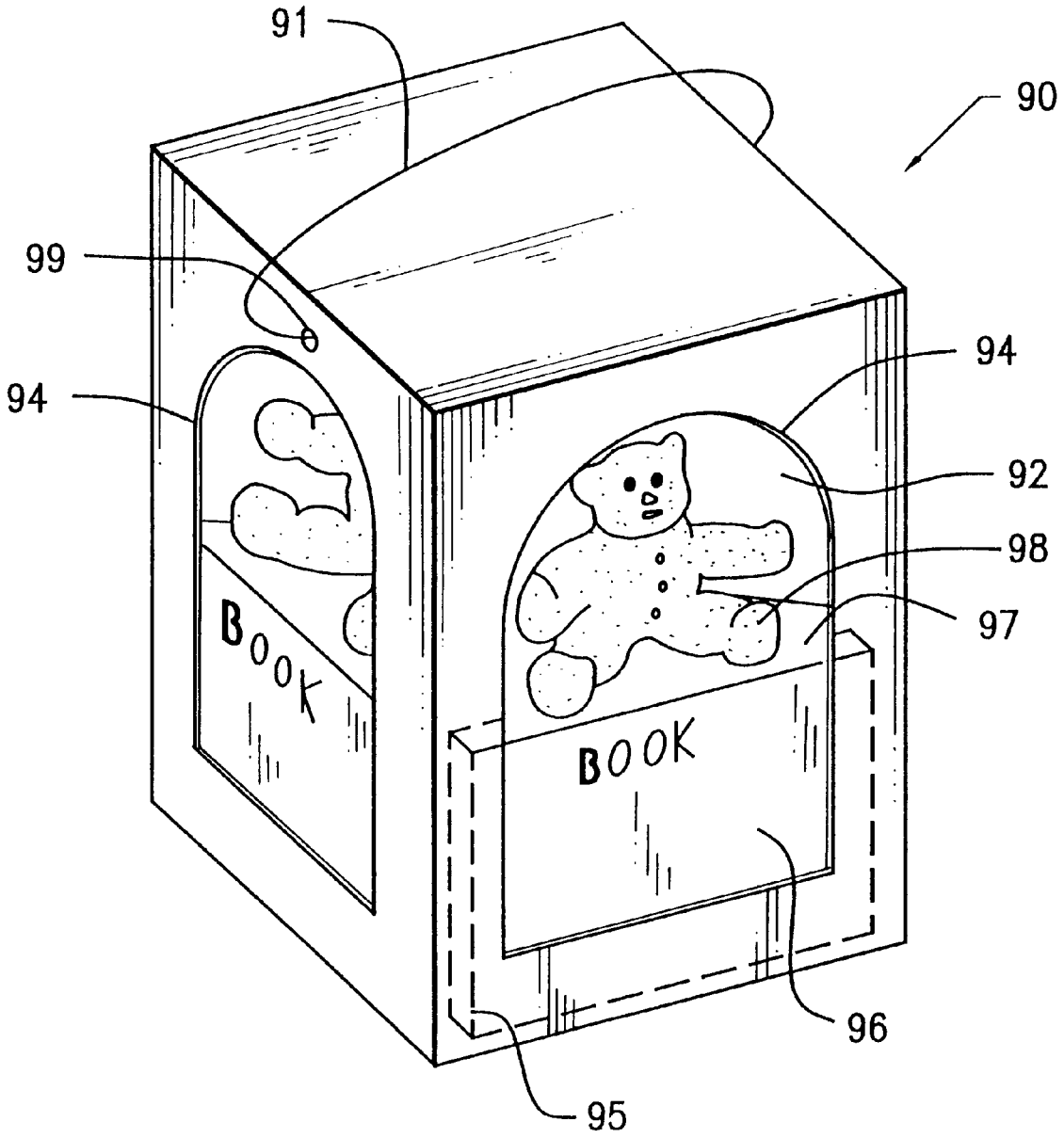
FIG. 4 shows a preferred embodiment of a container of the present invention.

In this manner, as shown in FIG. 4, there is provided a packaging container 90 eminently suitable for packaging four sets of books and toys combinations. As can be seen in FIG. 4, packaging container 90 has windows 94 on all four sides (two of which cannot be seen from the Figure). A book 95 is placed under the overhang of the triangular stand 97 which faces each window such that a portion 96 of the book 95 can be seen through the window 94. On top of the shelf 97 sits a toy 98 which is preferably related to the theme of the book, a character in the book or the theme of the set of book/toy combinations. The triangular opening 92 of the x-shaped insert can also be seen through the window 92.

Preferably, at least the portion of the triangular opening background 92 which is visible through window 94, and the top of shelf 97 is decorated to coordinate with the book/toy combination displayed in each of the respective windows.

A handle means comprising a rope 91 threaded through holes 99 on opposing sides of the container may also be provided.

In this manner, one can readily see that the packaging container of the present invention has many significant advantages over the prior art packaging devices. With the inserts, four book/toy combinations which preferably have a common theme may be sold in an attractive display case. Common themes such as books by the same author, books with the same character, books based on each of the four seasons, etc., can thus be effectively packaged in this manner. The packaging is of a simple relatively inexpensive construction and may be adapted for many embodiments. The packaging also provides a convenient means of transporting the set, thus facilitating play opportunities and encouraging reading by youngsters.

Many variations of the present invention will suggest themselves to those skilled in the art in light of the above-detailed description. For example, other suitable insert means for providing shelves and backgrounds may be employed. More than one window may be provided on each side, such as with a stacked shelve insert. Windows may also be provided on the top and bottom of the packaging. All such obvious modifications are within the full intended scope of the appended claims.

All of the above-referenced patents are hereby incorporated by reference in their entirety.

I claim:

1. A container and book combination including a plurality of books and related merchandise comprising a generally rectangular container having four sides and two ends defining an interior compartment space; wherein each of said four sides comprises a window displaying a book and related article therein; said container further comprising a means for partitioning said container into four quadrant, each said quadrant facing one of said windows; each said quadrant further comprising a means for shelving comprising a shelf suitable for supporting an object on top of the shelf and an overhang providing a storage space for a respective one of said books under said overhang such that both said object and said respective book are visible through its respective quadrant window, and wherein said shelf is decorated with a theme of the book stored under said shelf.

2. A container and book combination as defined in claim 1 wherein the decoration of the partition quadrant is coordinated with a theme of the book stored under the shelf in said quadrant.

3. A container and book combination as defined in claim 1 wherein each of the books stored under the shelves in the four quadrants have a common theme.

4. A container and book combination as defined in claim 1 further comprising a handle means.

5. A method for storing or displaying four related book and objects sets in a container and book combination article, said method comprising providing a generally rectangular container having four sides and two ends defining an interior compartment space; wherein each of the four sides comprises a window for displaying a book and object set therein;

providing said container with a means for partioning said container into four quadrants, each of said quadrants facing one of said windows placing in each of said quadrants of said container one of a plurality of books and a means for shelving comprising a shelf supporting an object on the top of the shelf and an overhang suitable for providing a storage space for said book under overhang, in a manner such that both said object and said book are visible through its respective window; and providing said shelf with a decoration which is coordinated with a theme of the book stored under said shelf.

6. A method as defined in claim 5 further comprising providing said partition means with a decoration to provide a background which can be viewed through each said respective window.

7. A method as defined in claim 6 wherein the decoration of the partition quadrant is coordinated with a theme of the book stored under the shelf in said quadrant.

* * * * *